US005677533A

United States Patent [19]

Yaktine et al.

[11] Patent Number: 5,677,533

[45] Date of Patent: Oct. 14, 1997

[54] APPARATUS FOR DETECTING ABNORMALLY HIGH TEMPERATURE CONDITIONS IN THE WHEELS AND BEARINGS OF MOVING RAILROAD CARS

[75] Inventors: Darrel L. Yaktine, Overland Park; Virgil F. Jones, Lenexa, both of Kans.

[73] Assignee: Science Applications International Corporation, San Diego, Calif.

[21] Appl. No.: 537,321

[22] Filed: Sep. 29, 1995

[51] Int. Cl.[6] ..... B61K 9/06

[52] U.S. Cl. ..... 250/342; 250/332; 250/334; 250/349; 246/169 A; 246/169 D

[58] Field of Search ..... 250/342, 349, 250/332, 334, 338.4; 246/169 A, 169 D

[56] References Cited

U.S. PATENT DOCUMENTS

| | | | |
|---|---|---|---|
| 2,818,508 | 12/1957 | Johanson et al. | 246/169 A |
| 3,183,350 | 5/1965 | Sibley | 250/349 X |
| 3,402,290 | 9/1968 | Blackstone et al. | 246/169 D |
| 5,331,311 | 7/1994 | Doctor | 246/169 D X |
| 5,422,484 | 6/1995 | Brogi et al. | 250/342 X |
| 5,448,072 | 9/1995 | Gallagher | 246/169 D X |
| 5,449,910 | 9/1995 | Wood et al. | 250/338.4 X |

FOREIGN PATENT DOCUMENTS

| | | |
|---|---|---|
| 424570 | 5/1991 | Germany . |

OTHER PUBLICATIONS

International Search Report.

*Primary Examiner*—Edward J. Glick

*Attorney, Agent, or Firm*—Pretty, Schroeder & Poplawski

[57] ABSTRACT

A method and apparatus are disclosed for sensing the temperature of bearings of vehicles traveling along a track, the apparatus including a linear-array infrared detector positioned adjacent to the track. The output from the linear-array infrared detector is scanned at a scanning rate that is regulated according to the vehicle's velocity, and this output is compared to predetermined thresholds to indicate excessive heat produced by the wheels and/or bearings.

29 Claims, 4 Drawing Sheets

FIG. 1
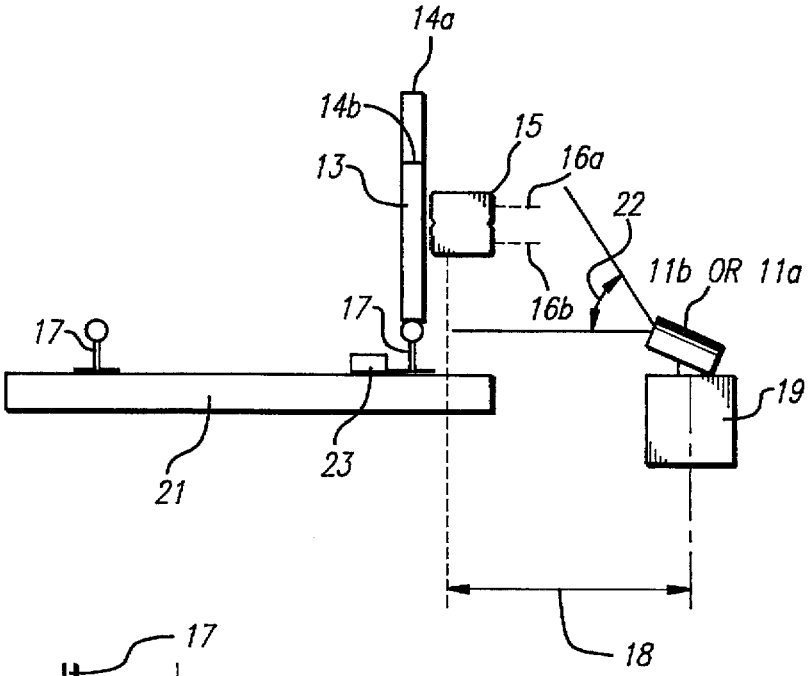
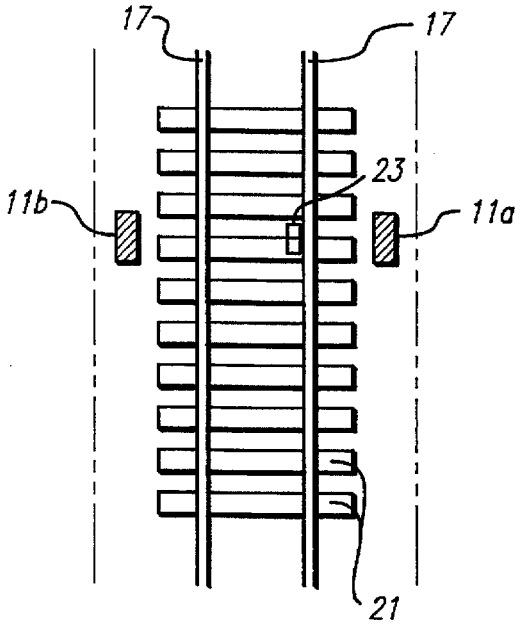
FIG. 2
FIG. 3
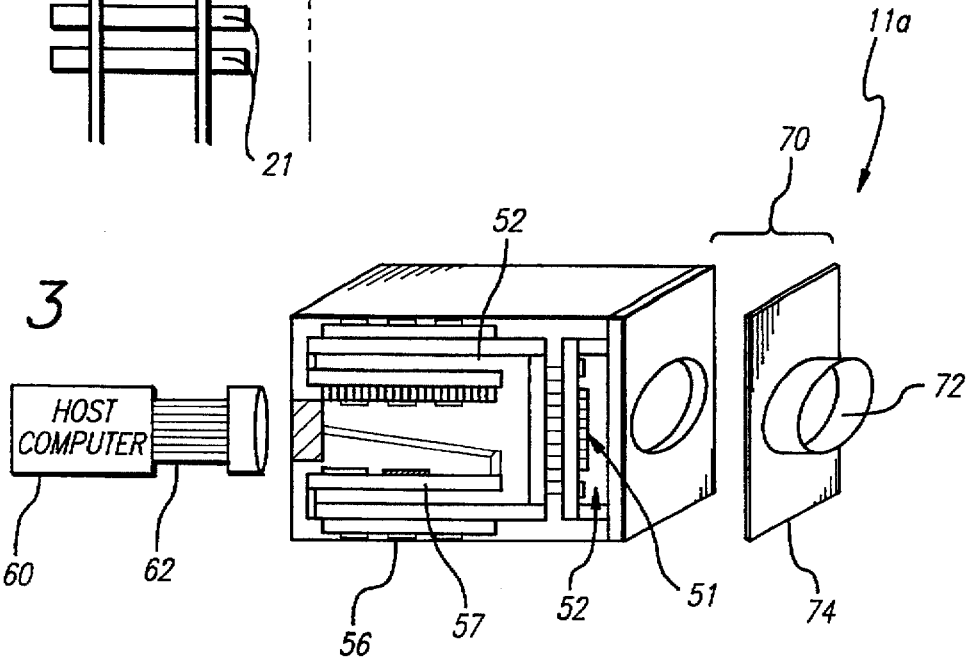

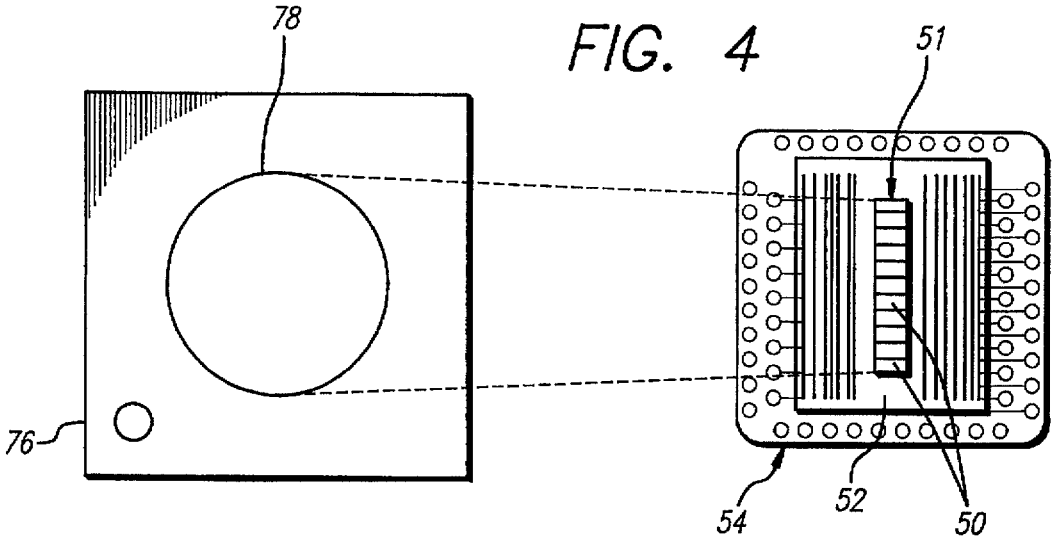
FIG. 4
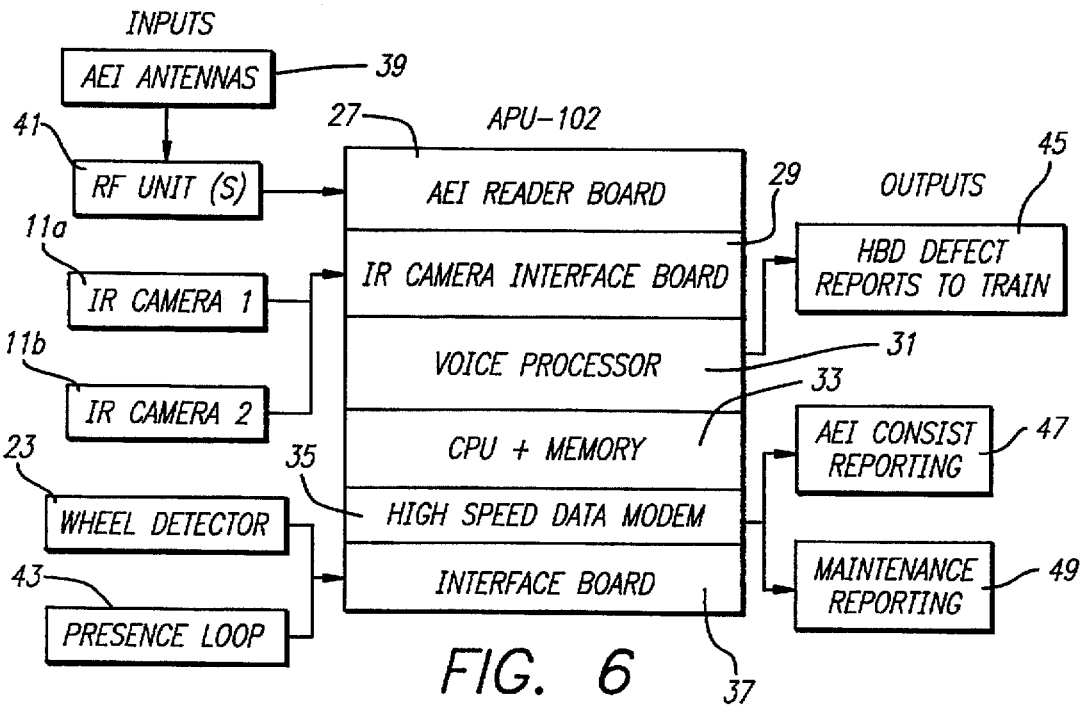
FIG. 6
FIG. 7a
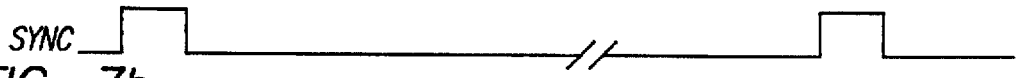
FIG. 7b
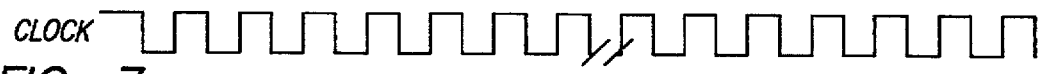
FIG. 7c
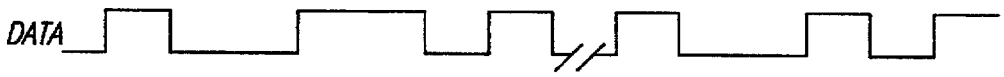

APPARATUS FOR DETECTING ABNORMALLY HIGH TEMPERATURE CONDITIONS IN THE WHEELS AND BEARINGS OF MOVING RAILROAD CARS

BACKGROUND OF THE INVENTION

This invention relates generally to apparatus for scanning objects as they move along a predetermined paths and, more particularly, to apparatus for scanning the cars of a railroad train moving along a track to detect abnormally high temperature conditions in the cars' wheel bearings.

The system employed by railroads since the mid1950's to determine an abnormal operating condition of a bearing on railway rolling stock is known as a Hot Box Detector or Hot Bearing Detector ("HBD"). By either name, the function of the devices used then and today are to determine if the temperature of a bearing or journal box on a railroad car is abnormal. This abnormal condition is indicative of a need for corrective action.

The first indication of a bearing failure is that of abnormal heat, so HBDs were deployed by the railroads as an answer to the increasing problem of derailments caused by these "hot boxes." Until the introduction of the HBD, the only method to determine a hot box was the presence of an odor and/or smoke, associated with journal oil becoming hot. It was the responsibility of the train crew, or a member of a wayside crew working along the track, to be alert for the tell-tale smoke. Typically when the smoke appeared, the bearing was well on its way to a catastrophic failure or a "burned off journal." An early warning device was needed.

The bearings of the early railroad rolling stock were actually brass or friction bearings. A brass block was lubricated by a film of oil between it and the highly polished "journal" of the axle, enclosed in the journal box. As long as nothing interfered with the supply of oil, this bearing performed it's job. If the oil supply were lost or contaminated, a "hot box" resulted. A hot box could easily result in a derailment, fire or both.

In the mid-'60s, the roller bearing appeared on railroad cars as a replacement for the traditional journal or friction bearings. This made the job of hot bearing detection even more difficult since the heat signature and failure heat of each bearing type is different. The tell-tale smoke does not appear until much later in the failure process when the bearing seals actually fail from the heat.

Roller bearings actually appear hotter to the scanners because the HBD scans the outer bearing race (cup) rather than the box associated that is associated with the friction bearing. Fortunately, the journal or friction bearings are soon to be removed from all cars used in interchange service.

HBDs introduced in the mid-1950s consisted of a number of wheel detectors attached to either rail, two heat scanners, and some means to process the signals from the wheel detectors and scanner. Originally the processed signal was sent via an FM carrier system, over open wire communication line, to an analog chart recorder in the train dispatcher's office. The chart recorder produced a "pip" corresponding to the relative heat of each bearing scanned. The train dispatcher was responsible to analyze the pips and determine if an abnormal condition existed based on the relative height of the pips and guidelines provided by the railroad. If an abnormal condition was noted, the dispatcher would notify the train crew by radio or signal indication, to stop and inspect that car.

As technology improved, automatic alarms were provided so the train dispatcher did not have to be attentive to the chart recorder output during the train passage. When the alarm indicator sounded, the dispatcher would then pay closer attention to the chart recorder. Technology continued to improve and wayside alarms were given to the train crew via a light array, then a tote board that indicated the number of the axle with the abnormal condition, and eventually to HBD systems employing a synthesized or digitized voice to construct an alarm message to be broadcast over the radio. Currently additional scanners are added to HBD systems to detect the presence of hot wheels caused by dragging or defective brakes—one single car or throughout the train.

At this time, hot bearing detectors are considered by railways to be a necessary evil. When they do their job, the pain of the cost of the system is forgotten. However, if a bearing is perceived to be missed by the HBD, there are long hours of explanations to and reasoning as to why the detector did not catch the bearing that burned off. Roller bearings can, and do, burn off, in as few as two miles, resulting in a derailment. A far worse scenario is when the detector properly alarmed the fact that there was an abnormal reading and either the train crew did not count the axles correctly or the detector system provided an inaccurate count of the defective axle.

The technology for determining the relative heat of each bearing senses the infrared radiation emitted from the bearing or journal box. This value of the heat measured is relative to some ambient reference. The two most popular devices used this method of non-contact temperature sensing are the thermistor bolometer and the pyroelectric detector.

It should, therefore, be appreciated that there is a need for an improved detection apparatus that can detect the occurrence of an abnormally high temperature condition in the wheel bearings and/or wheels of railway rolling stock, with greater reliability and with greater resolution. The present invention satisfies that need.

SUMMARY OF THE INVENTION

The present invention is embodied in an apparatus for inspecting the wheels and bearings of the cars of a moving railroad train, to provide a two-dimensional representation of the wheels and bearings and to detect the presence of any abnormal temperature condition in any of such wheels and bearings. The apparatus includes a linear-array infrared detector having an elongated, generally vertically oriented field of view and positioned adjacent to the track such that the field of view is traversed by the wheels and bearings of the cars as they move along the track. A scan controller periodically reads the infrared detector to produce a succession of scan signals, each representing the infrared energy received along the detectors field of view, such that while the wheels and bearings of the cars move through the detector's field of view, the succession of scan signals represent the infrared energy emitted by a two-dimensional area of such wheels and bearings. A processor receives the successive scan signals from the infrared detector and detects any abnormally high temperature condition in any wheel or bearing as the train moves past the infrared detector.

Other features and advantages of the present invention should become apparent from the following description of the preferred embodiment, taken in conjunction with the accompanying drawings, which illustrate, by way of example, the principles of the invention.

BRIEF DESCRIPTION OF THE DRAWINGS

FIG. 1 is a simplified elevational view of an infrared camera embodying the invention, positioned adjacent to a railroad track and oriented such that its field of view is traversed by the wheels and bearings of any railroad cars moving along the track.

FIG. 2 is a simplified plan view of a railroad track adjacent to which are positioned two infrared cameras of the kind depicted in FIG. 1, for scanning the wheels and bearings of any railroad cars moving along the track.

FIG. 3 is a schematic perspective view of the infrared camera of FIG. 1, with its housing eliminated, to reveal the camera's interior structure.

FIG. 4 is a simplified schematic diagram of a linear-array infrared detector and Germanium window that are part of the infrared camera of FIG. 3.

FIG. 6 is block diagram of apparatus for controlling the scanning of two infrared cameras of the kind depicted in FIGS. 1–5, to generate a succession of digital scan signals that combine to represent two-dimensional images of the wheels and bearings of any railroad cars moving along the track, and for processing those signals to detect the presence of abnormally high temperature conditions in any of the wheels and/or bearings.

FIGS. 7(*a–c*) illustrate a timing diagram showing the signals supplied to, and received from, the infrared camera.

DESCRIPTION OF THE PREFERRED EMBODIMENT

Figure 5:
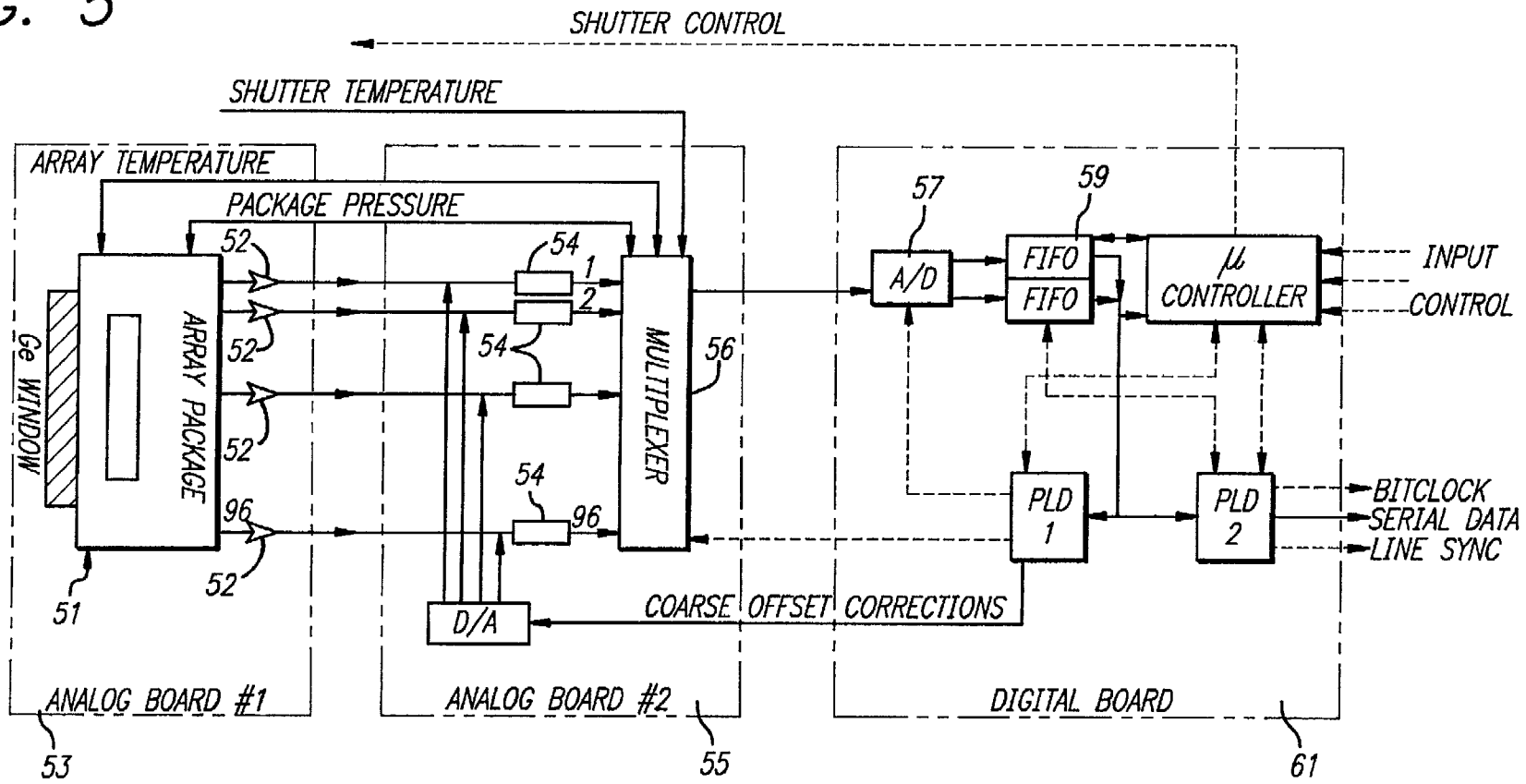
FIG. 5 is a simplified block diagram of the electronic circuitry of the infrared camera of FIGS. 3 and 4.

With reference now to the drawings, there is shown, in FIG. 2, an apparatus having two infrared cameras 11*a* and 11*b* that scan the wheels 13 and wheel bearings 15 of the cars of a railroad train as the train moves along a track 17, to produce a succession of digital scan signals representing a two-dimensional image of the wheels and bearings. This image data can be processed to detect abnormally high temperature conditions in any of the wheels and bearings, which can indicate a failure condition necessitating the alerting of the train engineer.

With particular reference now to FIGS. 1 and 2, the infrared cameras 11*a* and 11*b* (FIG. 1 illustrates only one infrared camera) are positioned on opposite sides of the railroad track 17, at a distance 18 about 1.0 meter beyond the center of the bearing 15 of a typical railroad car wheel 13. Such bearings typically have a generally cylindrical shape, projecting outwardly from the wheel about 0.3 meters with a diameter of about 0.15 meters. Each camera is mounted on a stable platform 19 that is mechanically isolated from the vibration of the track rail 17 and cross ties 21. Further, each camera has a vertical field of view 22 of about 76 degrees, which provides a vertical scan height of about 1.2 meters at a range of 1 meter.

In FIG. 1, two possible wheel sizes (and two different bearing positions) are illustrated. This is necessary, since rolling stock having wheels of different diameters often use the same tracks. For example, in FIG. 1, the wheel 13 will extend from the track to height 14*a* if the wheel is a large 40-inch diameter wheel. By comparison, the wheel 13 extends to level 14*b* if it is a smaller, 28-inch diameter wheel.

Although the wheel 13 might have a wide range of dimensions, as described above, the bearing 15 applied to the wheel 13 is preferably of the same size, typically measuring 6½ inches by 12 inches. Since the wheels are of different sizes, as described above, the center of the bearings 15 rides at either vertical level 16*a* or 16*b*. The scan of the infrared camera 11*a* or 11*b* covers both levels 16*a*, 16*b*.

Each infrared camera 11*a* or 11*b* includes a linear array of infrared-sensitive elements oriented generally vertically. In the preferred embodiment, the camera includes 96 such elements, whereby a resolution of about 0.015 meters is provided at a range of about 1.8 meters. In use, as a railroad train moves along the track 17, the 96 photo-sensitive elements of each camera are repeatedly read out, to produce a succession of scan signals that represent a vertically oriented raster scan of train. Data representing a two-dimensional image of the train's entire complement of wheels and bearings, thereby, is accumulated. A typical two-dimensional image, depicting the infrared energy received from two wheels 13, is depicted in FIG. 8B or FIG. 8D is reproduced.

Figure 8A:
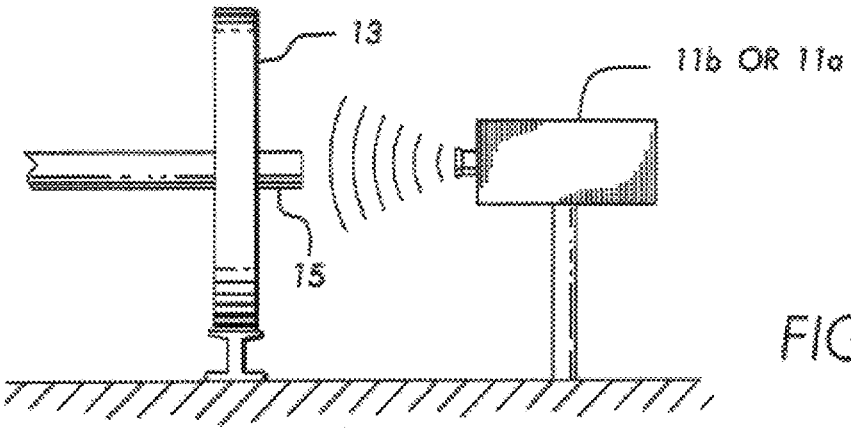
FIG. 8A is a schematic diagram of the FIG. 1 embodiment, with the infrared camera 11*b* in a nearly level position.
Figure 8B:
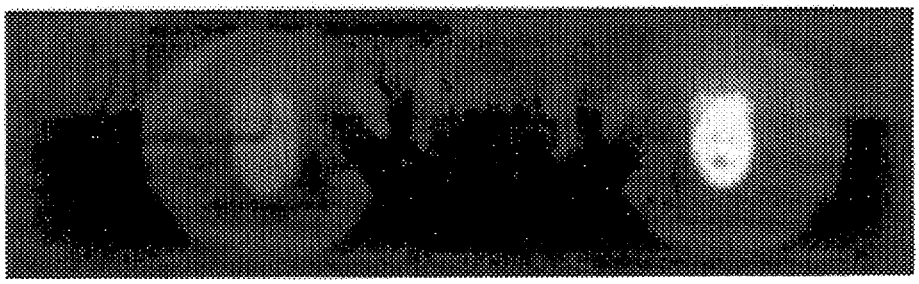
FIG. 8B is a depiction of a representative two-dimensional image produced by the infrared camera apparatus of FIG. 8A, as a railroad car moves along the track, past the infrared camera of FIG. 1.
Figure 8C:
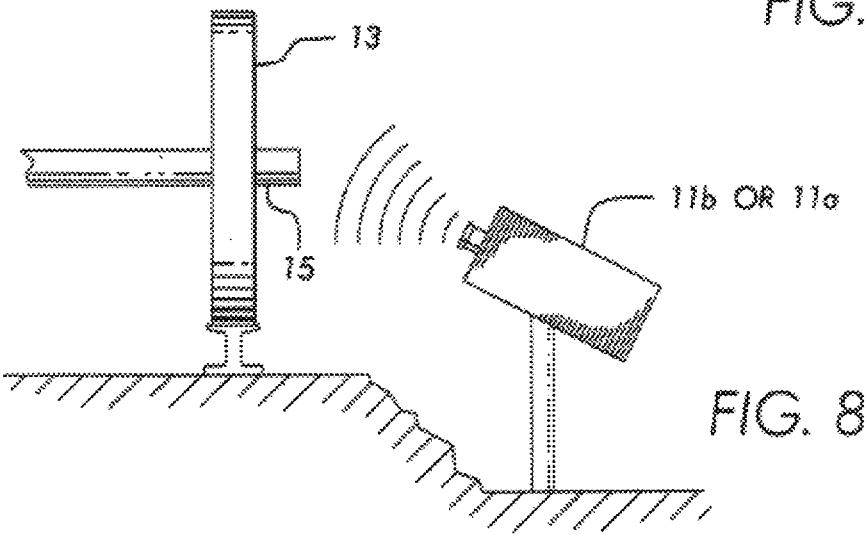
FIG. 8C is a schematic diagram similar to FIG. 8A, except with the infrared camera positioned in an upwardly angled direction.
Figure 8D:
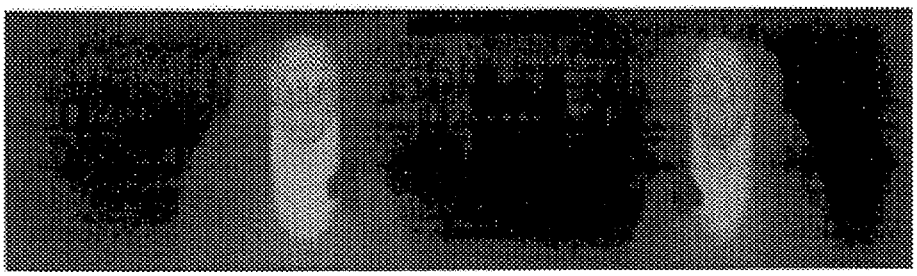
FIG. 8D is a depiction of a representative two-dimensional image produced by the infrared camera apparatus of FIG. 8C, as a railroad car moves along the track past the infrared camera of FIG. 1.

FIG. 8A is a schematic diagram of the FIG. 1 configuration when the infrared camera 11*a* or 11*b* is in a level position. The resulting image produced by the infrared camera 11*a* or 11*b* in FIG. 8A is illustrated in FIG. 8B. FIG. 8C is a similar view to FIG. 8A, except that the infrared camera 11*a* or 11*b* is mounted at an angle to view the wheel bearings 15. Note that the image produced in FIG. 8B is less elongated than the image produced in FIG. 8D. Comparing FIGS. 8B to 8D indicates that the image produced by the cameras at least partially depend upon the position and angle of the infrared cameras relative to the wheel bearing. Therefore, the position and angle of the camera with respect to the wheel bearings have to be considered when determining the type of images that indicate overheating.

The repeated read-out, or scanning, of the two infrared cameras 11*a* and 11*b* preferably is effected at a uniform rate that varies according to the detected speed of the train moving along the track 17. In this way, the aspect ratio of the two-dimensional image can be effectively controlled. A wheel speed detector depicted schematically by the reference numeral 23 in FIG. 2, detects the passage of the train's successive wheels 13, to provide a measurement of the train's speed, and this measurement is then used to control the camera's read-out rate.

In the preferred embodiment, the linear array of photo-sensitive elements of each camera 11*a* or 11*b* is read out each time the train has been detected to have moved about 0.025 meters. At this rate, data representing a two-dimensional image having vertical resolution of about 0.0125 meters and a horizontal resolution of about 0.025 meters is provided. At a train speed of about 60 miles per hour, this read-out rate corresponds to about 1000 scans per second.

With reference now to FIG. 6, there is shown an overall, system-level block diagram of the apparatus for thermally scanning the wheels 13 and bearings 15 of a moving railroad train. As depicted, the system in integrated together with a conventional automatic equipment identification (AEI) controller, which cooperates with rf units mounted on each railroad car to create a log of all passing cars. An example of such an AEI controller is a unit sold under the name APU-102, by Sintonic, an SAIC Company, of Kansas City, Mo. The apparatus of the invention, in addition to the infrared cameras 10*a* and 10*b*, includes several printed circuit board cards that can conveniently be mounted within the housing of an APU-102 controller.

As shown in FIG. 6, the APU-102 controller is shown to include an AEI reader board 27, an infrared camera interface board 29, a voice processor 31, a CPU and memory 33, a high-speed modem 35, and an interface board 37. The AEI reader board 27 interfaces with AEI antennas 39 and rf units 41 associated with the conventional AEI system, which as mentioned above creates a log that identifies all railroad cars moving past the apparatus along the track. The infrared camera interface 29 interfaces with the two cameras 11*a* and 11*b* located on opposite sides of the track 17. The organization and operation of this infrared camera interface board is described below. The interface board 37 interfaces with a conventional wheel detector 23 and car presence detector 43, which provide an indication of the presence and speed of a car moving along the track. As mentioned above, these indications are used to properly time the read out of the two cameras 11*a* and 11*b* so as to provide image data having the desired, uniform aspect ratio.

The voice processor 31 is used in connection with a subsystem 45 that provides audible defect reports to the train's engineer. Finally, the high-speed data modem 35 interfaces with an AEI consist subsystem 47 and a maintenance reporting subsystem 49, in a conventional fashion.

Infrared cameras having the specified spatial resolution and capable of being read out at the specified repetition rate of at least 1000 scans per second are available from several commercial sources, including Litton Election Devices, of Tempe, Ariz. Although such cameras are effective for use in this application, they suffer the drawback of requiring thermoelectric cooling for the infrared-sensitive array. This requirement can add significantly to the camera's cost. An infrared camera having the specified capability without requiring cooling can be obtained from Honeywell Inc., of Minneapolis, Minn. Such a camera is described below, with reference to FIGS. 3–5.

The camera 11*a* includes a plurality of thermo-electric microthermopile found in a linear array 51 fabricated on a silicon microstructure or motherboard 52, which has excellent sensitivity to broadband infrared energy, especially 8–14 micrometers. The silicon microstructure 52 may be packaged within a KOVAR package 54 ("KOVAR" is a trademark at the Westinghouse Electric and Manufacturing Company), the KOVAR package acts to protect the motherboard and provide electrical contacts for the linear array 51. Any other packaging that provides similar protection may be used. This array operates uncooled at room temperature, does not require a chopper, and can detect room temperature objects.

The camera 11*a* accumulates 96 line snapshots (vertical axis) of 96-pixel data that are stored in electronic memory. This data is then used to construct a full 96-sample wide two-dimensional infrared image, with time (object motion) providing the horizontal axis. Electronics include low-noise preamplifiers, multiplexers, control logic, and digital memory to store the images from the array. The camera circuit is fabricated using surface-mount techniques on a rigid-flex, multi-layer circuit card, to reduce system noise. The overall system noise equivalent temperature difference (NETD) of less than 0.2° C. is obtained. The imager performance enables clear recognizable images to be obtained, at night or in bad visibility conditions.

Significant progress has recently been made in the development of large two-dimensional staring arrays (cooled and uncooled), for critical infrared imaging applications. There is a payoff in reducing overall system complexity required for achieving high performance that some technologies demand (as with scanning and/or cooling systems). Some applications may require more stringent power limitations and system simplification, while retaining the desire for infrared imaging capability under certain scenarios. The linear array staring camera accumulates sequential line snapshots (vertical axis) of 96-pixel data that are stored in electronic memory.

The infrared-sensitive linear array 51 uses a "microbolometer-type" micro-thermocouples concept (hereafter called microthermopile) that is based on all-silicon solid state technology. The linear array has a small thermal mass, for fast response time and is extremely well isolated from the substrate, for high sensitivity. Each of the elements functions like a bolometer with an onboard thermocouple: absorbing broadband infrared radiation which heats the thermally isolated area, while having thermoelectric junctions on it, thus directly giving voltage readout as the element heats up.

Several advantages to this thermoelectric microthermopile approach exist over other types of infrared sensors. These advantages include: 1) all-silicon batch processing, which allows for production of large, low-cost, highly producible arrays, 2) elimination of a chopper or mechanical scanner, 3) broadband (especially 8–14 μm) sensitivity, which permits measurement of room temperature objects without requiring cooling of the sensor, and 4) extremely small thermal mass and excellent thermal isolation, which provides high sensitivity.

Each element of the thermoelectric linear array 51 is fabricated on a thin microbridge of silicon nitride and consisted of a thermopile of several nickel-iron/chromium micro-thermocouples connected in series. Each microthermopile is fabricated so as to be thermally connected with the silicon substrate and thus the ambient environment. The silicon nitride microbridge effectively thermally isolates one leg of this thermopile structure and provides a very small thermal mass to increase the elements' sensitivity. A voltage is induced which is proportional to the temperature difference between the thermally isolated and non-isolated leg which is proportional to the total infrared energy absorbed by the thermoelectric element. The thermoelectric detector element does not need any bias current (as is required for a resistive bolometer). This allows the thermoelectric array to operate using very low power, i.e., battery operation).

A figure of merit used to evaluate the overall sensor performance is the noise equivalent temperature difference (NETD), which is the object temperature change needed to produce a detector signal change equal to the root mean squared (RMS) noise of the sensor. NETD incorporates the detector performance, as well as the RMS noise of the sensor electronics, so improvements come from two fronts, improving the detector, as well as lowering the RMS noise. As NETD decreases, smaller temperature changes (better measure of uniformity) can be seen in the object of interest.

A numerical estimate of D* and NETD for these thermoelectric detectors can be calculated. The electronic noise will be Johnson noise of the sensor resistance, preamplifier noise and thermal fluctuation noise but the latter two sources can be neglected for these detectors. Since thermoelectric detectors operate at zero applied bias, there can be no 1/f noise in the detectors or their contacts. This eliminates all difficulties with noise contacts, material 1/f noise sources, and so forth. The expected performance for these thermoelectric detectors can be calculated as follows:

Responsivity of 108 V/W,

D* of $1.2\times10^8$ (cm $\sqrt{H_2/W}$), and

NETD of 0.10° C., with F# of 0.73.

It is worthwhile noting that very good NETD values (0.1° to 0.2° C.) can be obtained with uncooled thermoelectric sensors in real imaging systems, in spite of the fact that their D* and responsivity values are low compared with cooled infrared sensors. The reason for this is that thermoelectric detectors are operated in a "staring" rather than a "scanning" mode of operation, producing very low RMS noise levels over the (low) bandwidth of the imaging electronics. Since the practical figure of merit for the sensitivity of an infrared imager is NETD (not D* or responsivity), thermoelectric sensors allow high sensitivity room-temperature imaging systems to be attained. These thermoelectric microthermopile sensors show an experimentally demonstrated chopperless NETD of 0.16° C. with a 5-millisecond pixel time constant and a 1.58-kHz amplifier bandwidth.

The array is housed in a permanently sealed vacuum package, to further thermally isolate the thermoelectric elements, improve the NETD, and demonstrate compactness and portability. A diagram of the array and the package is seen in FIG. 5.

To reduce the size of the imager, extensive use is made of surface-mount electronic techniques. A flexible multi-layer circuit card eliminates board-to-board connectors and provided shielded ground planes between signal layers to reduce noise. A small mechanical housing contains the sensor and electronics, to provide a mounting structure for the lens and external connector.

The infrared camera 11*a* or 11*b* described briefly above is controlled remotely by infrared camera interface board 29 (FIG. 6), which controls the periodic read out of the camera array's 96 infrared-sensitive elements. In FIG. 6, all dotted connector lines in the drawings are control lines; while all solid connector lines in the drawings are data transfer lines. With reference to FIG. 3 and 5, the complete array is scanned a rate of up to about 1000 scans per second. The pixel signals are individually amplified by preamps 52 on a first analog board 53 located within the camera. The 96 amplified signals are passed to a second analog board 55, where they are integrated, by integrator 54, and time multiplexed, by multiplexer 56, in a 12-bit A/D converter 57. A complete linescan of pixel data is held in a linescan memory 59 on a digital board 61 and is sent to a host computer 60 during the following 1 msec linescan time via cables 62. It is preferable that many of the cables and connectors used in the present invention be flexible to permit containing all of the above elements within a desired space.

Because of relatively large offsets inherent in commercial preamplifiers 52, each of the analog signal channels shows a random offset of several volts, measured at the integrator outputs. These offsets are individually trimmed to be close to zero volts during the camera RESET mode. This offset correction mechanism is a "coarse" offset correction, intended to preserve maximum system dynamic range, and not intended to provide removal of pixel-to-pixel offsets to a level corresponding to the system noise level.

Pixel-to-pixel offsets are removed by closing a shutter 70 across the field of view of all sensors as shown in FIG. 3. The shutter 70 includes a lens structure 72 retained in a bracket 74 and a cover plate 76 that contains a window 78. The shutter operates in a manner generally known in the camera and imaging arts, and permits the passage of light into linear array 51. While the shutter is closed sixteen or more linescans are collected and stored and averaged in the host computer. To provide a full offset correction these averaged digital values are subtracted from pixel signals obtained when viewing a scene.

If the camera system's temperature changes by 1 degree C or more, system offsets will probably require an update. In the linescan mode, the sensor package temperature is measured every linescan. This temperature may be used by the host computer to indicate the camera system temperature.

The sensor package is evacuated. A pressure sensor is incorporated in the package, and the system can interrogate this pressure sensor to confirm proper vacuum is maintained.

The system may require a warm-up time of up to three minutes after a cold power-on. During this period calibration data may be unreliable.

The signals provided to and from the infrared camera 11*a* are identified below in Table 1. All of these signals are in the form of differential twisted-pair serial data.

TABLE 1

Communication Interface

| Signal Name | Description |
|---|---|
| DATA OUT | serial data output from camera (see format below) |
| CLOCK OUT | 1.5 MHZ (approx.) clock output from camera, data valid on rising edges |
| SYNC OUT | high for one clock period at start of each transmission of linescan data, and at start of each transmission of calibration data |
| CONTROL1 IN | control input, sets camera status (see truth table below), new camera status commands are implemented at start of following linescan |
| CONTROL2 IN | control input, sets camera status (see truth table below), new camera status commands are implemented at start of following linescan |
| CONTROL3 IN | control input, sets camera status (see truth table below), new camera status commands are implemented at start of following linescan |

CONTROL1 IN, CONTROL2 IN AND CONTROL3 IN are control lines which set the operating mode of the camera. These control lines can be changed at any time. If these control limes are changed to a new mode setting, the new mode will start immediately after the current mode completes its normal cycle. These modes are summarized in Table 2.

TABLE 2

Control Line Truth Table

| Camera Status | Description of Operation | CONTROL 1 IN | CONTROL 2 IN | CONTROL 3 IN |
|---|---|---|---|---|
| Idle | camera waiting for linescan command, shutter open | 0 | 0 | 0 |
| Normalize | measure fine pixel offsets, shutter closed | 0 | 1 | 0 |
| Calibrate | send calibration data to host computer, shutter closed | 1 | 0 | 0 |

TABLE 2-continued

Control Line Truth Table

| Camera Status | Description of Operation | CONTROL 1 IN | CONTROL 2 IN | CONTROL 3 IN |
|---|---|---|---|---|
| RESET | camera performs reset sequence | 1 | 1 | 0 |
| Linescan | camera scans target, shutter open | 1 | 1 | 0 |
| reserved | | 0 | 1 | 1 |
| reserved | | 1 | 0 | 1 |
| reserved | | 1 | 1 | 1 |

Operation of the camera in these various modes is described below:

1. Linescan mode:

In this mode, the camera scans the target and outputs data continuously to the host computer, with a data delay of linescan time. As set forth in Tables 3 and 4, data is output as pairs of 8 bit bytes, each pair forming a 16-bit word, high byte first. A header is initially transmitted, followed by the sequential linescan data SYNC OUT goes HIGH in the clock cycle marking bit #1 of each packet. The data words can be converted into real temperature values (degrees C.) using the equations set forth below.

TABLE 3

General Packet Format

| Element | Data | # Bytes |
|---|---|---|
| 1 | Data Type (camera Mode)<br>1 = Linescan Data. 2 = Calibration Data | 2 |
| 2 | Packet Length (excluding checksum) | 2 |
| 3 | Camera Serial Number | 2 |
| 4 | Date [1] (Depends on Data Type)<br>" . . . "<br>Data [n] | 1 |
| 5 | Checksum | 2 |

TABLE 4

Linescan Packet Format

| Element | Data | # Bytes |
|---|---|---|
| 1 | 1 = Linescan Data | 2 |
| 2 | Packet Length (excluding checksum) | 2 |
| 3 | Camera Serial Number | 2 |
| 4 | Camera Status<br>D0 = Shutter State, 1 = Open,<br>D1 = Vacuum State | 2 |
| 5 | Sequence Number | 4 |
| 6 | Data [1] Pixel 1<br>" . . . " | 2 |
| 7 | Package Temperature | 2 |
| 8 | Shutter Temperature<br>Data [96] Pixel 96<br>PF TWP -- 2 bytes<br>bytes--pressure | 2<br>2 |
| 9 | Checksum | |

2. Normalize mode:

Camera operation in this mode is identical to linescan mode except that the shutter is closed and it uses the same word format.

During this mode, the host computer should collect as least 16 linescans and average the pixel words for each pixel (I=1,2,3 . . . 96). It should also collect and average the shutter temperature words. These numerical values are used to convert digital data obtained in the linescan mode to real target temperatures using the formulae provided in the calculation section of this document and in internally stored calibration constants.

3. Calibration mode:

Calibration radiometric constants are stored in the camera and are transmitted to the host computer in this mode. The data format in this mode is set forth in Tables 5 and 6. Data will be transmitted as a series of pairs of 8-bit bytes, each pair forming a 16 bit word, high byte first. SYNC OUT will be sent HIGH during the clock cycle when the first bit of the first word is transmitted. The complete data sequence will be sent along with a checksum to allow communication errors to be sensed.

TABLE 5

Calibration Data Packet Format

| Element | Data | # Bytes |
|---|---|---|
| 1 | 2 = Calibration Data | 2 |
| 2 | Packet Length (excluding checksum) | 2 |
| 3 | Camera Serial Number | 2 |
| 4 | Number of Sequences | 2 |
| 5 | Sequence Number | 2 |
| 6 | A0 . . . A5 for Pixel 1 | 24 |
| 7 | A0 . . . A5 for Pixel 2<br>" . . . "<br>A0 . . . A5 for Pixel 18 | 24<br><br>24 |
| N | Checksum | 2 |

TABLE 6

Calibration Data Packet Format (last packet)

| Element | Data | # Bytes |
|---|---|---|
| 1 | 2 = Calibration Data | 2 |
| 2 | Packet Length (excluding checksum | 2 |
| 3 | Camera Serial Number | 2 |
| 4 | Sequence Number | 2 |
| 5 | Number of Sequences | 2 |
| 6 | A0 . . . AS for Pixel 91 | 24 |
| 7 | A0 . . . A5 for Pixel 92<br>" . . . "<br>A0 . . . A5 for Pixel 96 | 24<br><br>24 |
| 14 | Camera Calibration Date | 2 |
| 15 | Checksum | 2 |
| 16 | D1 | 4 |
| 17 | D2 | 4 |
| 18 | E1 | 4 |
| 19 | E2 | 4 |
| 20 | S1 | 4 |
| 21 | S2 | 4 |
| 22 | Package Pressure | 2 |

4. RESET mode

In this mode, the camera control system logic is reset and the camera enters a setup sequence in which the following items occurs in series under control of an onboard microcontroller:

1) the shutter is closed
2) coarse offset correction is applied to all analog channels
3) the sensor package internal pressure is measured
4) the shutter is opened and the camera systems automatically enters the linescan mode.

This sequence is expected to take less than 1 minute.

Target Temperature Calculation

The host computer can calculate the target temperature in degrees C. of pixel i of linescan N ($T_N^{(j)}$ where j=1,2,3 . . . , 96) using pixel word $X_N^{(j)}$, the shutter temperature signal $T_1$, and sensor package temperature signal $T_2$, by applying the following formulae:

$$T_N^{(1)}=(P_N^{(1)}-Q)R$$

where $$X_n^{(1)}=S_1(X_n^{(1)}\text{shutter open}-S_2X_{n-1}^{(1)}\text{shutter open})-X^{(1)}\text{shutter closed}$$

$$P_n^{(1)}=(A_n+A_1X_n^{(1)}+A_2X_n^{(1)2}+A_3X_n^{(1)3}+A_4X_n^{(1)4}+A_5X_n^{(1)5})$$

$$Q=(B_0+B_1T_1+B_2T_1^2+B_3T_1^3B_4T_1^4+B_5T_1^5)$$

$$R=(C_0+C_1T_2+C_2T_2^2+C_3T_3^3+C_4T_2^4+C_5T_2^5)$$

where A's are the constants provided for each individual pixel, and the B's and C's are camera constants.

$X_N^{(1)}$ shutter open is the pixel word for pixel i on linescan N (i=1,2,3, . . . 96)

obtained with the shutter open, and $X^{(1)}$ shutter closed is the pixel word obtained for pixel i with the shutter closed, averaged—16 or more linescans (see nomalize mode).

The temperatures of the shutter and the sensor package temperature are given in degrees C. by the following formula:

$$T_{shutter}=T_1D_1+E_1$$

$$T_{sensor\ package}=T_2D_2+E_2$$

where $D_1$, $D_2$, $E_1$, and $E_2$ are camera calibration constants.

note: target temperatures are calculated assuming a target emissivity of 1.0.

As shown in FIGS. 7(*a–c*), the output from the camera 11 consists of three signals—serial data, sync and clock. Data is transmitted as 16-bit words and the most significant bit of the word is transmitted first. Double words (32 bit data) are transmitted in the same fashion. The sync line goes high for the first bit time of the packet and remains low at all other times. Clock is transmitted whenever valid data is present on the data line. The clock rate is expected to be about 2 MHz. Data should be clocked into the receiving register on the positive going edge of the clock. At any time that valid data is not available for transmission, the clock will be interrupted until valid data is available for transmission. This can occur only at a word boundary.

The linescan board is a dual channel data capture device with the following features:

- The ability to save 128 K scans of 128 16 bit data words per channel (32 MB)
- Choice of 16 or 32 MB of memory per channel
- Memory modules in convenient SIMMs for easy memory upgrades, and high density
- Memory accessable via a 32 K memory window on the STD bus.
- Scan rate register to allow 16-bit scan rate selection from 2 microseconds to 131 microseconds per scan.
- A 17-bit scan line address counter, resettable by the STD host.
- A register allowing reading of the scan line address at any time by the host.
- A register allowing reading of the status of each camera at any time.
- Differential IO signals to each camera via PC mount DB15 connectors.

The boards can be constructed with 16 megabytes per channel, and expansion SIMMs can be added, as needed.

A register map for the linescan board is set forth below in Table 7.

TABLE 7

| | |
|---|---|
| Base address<br>Command Register | |
| 7 | Reset scan line counter (1) |
| 6 | Scan Enable (1) |
| 5 | Camera 1 Control 2 |
| 4 | Camera 1 Control 1 |
| 3 | |
| 2 | |
| 1 | Camera 2 Control 2 |
| 0 | Camera 2 Control 1 |
| Base Address +1<br>Memory Window Control | |
| 7 | Channel Select 0 = Channel 1 memory in window<br>1 = Channel 2 memory in window |
| 6 | Memory enable = 1 |
| 5 | |
| 4 | |
| 3 | |
| 2 | |
| 1 | MemA24 Upper bits of page address in window |
| 0 | MemA23 |
| Base Address +2 | |
| 7 | MemA22 |
| 6 | MemA21 |
| 5 | MemA20 |
| 4 | MemA19 |
| 3 | MemA18 |
| 2 | MemA17 |
| 1 | MemA16 |
| 0 | MemA15 |
| Base Address +3 PIA control register<br>Base Address +4 Status register (Read only) | |
| 7 | Camera 1 Sync out |
| 6 | Camera 2 Sync out |
| 5 | |
| 4 | |
| 3 | |
| 2 | |
| 1 | |
| 0 | SL16 Scan line address |
| Base Address +5 Scan line MSB (Read only) | |
| 7 | SL15 Scan line address |
| 6 | SL14 |
| 5 | SL13 |
| 4 | SL12 |
| 3 | SL11 |
| 2 | SL10 |
| 1 | SL9 |
| 0 | SL8 |
| Base Address +6 Scan Line LSB (Read only) | |
| 7 | SL7 |
| 6 | SL6 |
| 5 | SL5 |
| 4 | SL4 |
| 3 | SL3 |
| 2 | SL2 |
| 1 | SL1 |
| 0 | SL0 |
| Base Address +7 PIA control register<br>Base Address +9 Scan rate MSB<br>Base Address +10 Scan rate LSB | |

Alternate addressing of board address

Memory buffer addressing:

A14–A0 are derived from the STD bus address being generated, and are OR'ed with MemA15 . . . MemA24 to select a particular address from the 32 MB of memory windows, each containing 32 KB of data.

The camera signals are to be brought out of the card via two DB15 connectors. There is insufficient board width to use two DB-25 connectors for this purpose. The pinouts for both connectors are set forth in Table 8.

TABLE 8

| | | |
|---|---|---|
| 1 | Input | Camera Data+ |
| 2 | Input | Camera Data– |
| 3 | Input | Camera Clock+ |
| 4 | Input | Camera Clock– |
| 5 | Input | Camera Sync+ |
| 6 | Input | Camera Sync |
| 7 | GND | |
| 8 | GND | |
| 9 | Output Control 2+ | |
| 10 | Output Control 2– | |
| 11 | Output Control 3+ | |
| 12 | Output Control 3– | |
| 13 | Output Control 1+ | |
| 14 | Output Control 1– | |
| 15 | V++ | |

Advantages of the apparatus described above include the following:

Present systems measure temperature relative to ambient, making it difficult to explain to senior RR management when discussing the conditions surrounding a bearing failure. The new system will provide an absolute temperature measurement for analyzing failures and setting alarm criteria.

Traditionally the magnitude of the temperature of a hot bearing has been expressed in millimeters of pen deflection of a chart recorder. The millimeters can be related to the Centigrade degrees of temperature rise about ambient, but interpretation of the chart and the math calculations of the HBD system lead to significant inaccuracies, in particular when a single degree can mean the difference between an alarm and no alarm. Data in the form of absolute temperature measurements are much easier to understand.

Winter is an extremely difficult season for HBD systems because of the ambient reference factor on which the system is based. The current pyro and bolometer technologies appear to be very sensitive to extreme and quick shifts in ambient temperature due to the time it takes for the ambient reference to change to the actual ambient temperature. The thermoelectric technology used in the infrared camera is insensitive to variations in ambient temperature.

There is no absolute criteria regarding the actual temperature at which a roller bearing has failed. Roller bearing manufacturers have indicated that grease seals begin to melt at temperatures above 180° F. However, measurement inaccuracies, heat conductivity, the location scanned, track conditions, loading, weather conditions all contribute to system inaccuracies. By increasing the amount of temperature information, the infrared camera will be able to make use of more sophisticated analysis routines in order to determine bearing condition.

Current rail mounted scanners and sensor units are subject to severe vibration and shock. Maintenance is increased because of this factor. Rail mounted scanners are also difficult to install on concrete ties. The IR camera will not be mounted to the rail.

Previous generation ballast-mounted scanners are difficult to accurately align in position with the wheel detectors during rail run and the swelling of the earth during freeze and thaw conditions. The infrared camera has such a wide field of view that it will be quite insensitive to minor changes in alignment.

Current sensor technology and analysis of the heat signatures can be fooled by extraneous heat sources . . . sun, sky, steam pipes on passenger equipment, flying brake shoe scale from dragging brakes, hot wheels from dragging brakes as a result of only measuring the temperature at a single spot. The IR camera will be able to identify and ignore temperature measurements that do not originate from the bearing.

Current systems can only provide an axle count and the side of the train on which the alarm is located. Inaccurate counting by the crew will often lead to an alarmed axle being missed. Integrating an AEI system solves this problem.

Present systems are using an inboard scan are sensitive to new bearings. The rear bearing seal is located within the scan spot of both the Harmon and Servo detector systems. Until the seal has gone through its break-in period, it provides above normal heat indications that can result a false alarms. The infrared camera will be able to view the whole bearing.

Thermistor bolometers and pyro electric devices are subject to microphonics. The infrared camera uses thermoelectric technology that is not subject to microphonics.

Complex alarm algorithms have been created to eliminate false stops. Some algorithms have helped . . . car side analysis, three slope algorithm, bearing identification. However, the limited information provided by a single spot limits the analysis that can be performed.

Thermistor bolometers require noise free, high voltage power supplies. The infrared camera makes use of a simple low voltage power supply.

Wheel sizes and train direction affects the time the bearing intersects the scan line. Current sensor technology requires three time constants for a reading. The infrared camera will be unaffected by wheel size and train direction due to its wide field of view.

Hot wheel detection requires the use of additional scanners. The wide field of view of the infrared camera includes a view of the entire wheel.

Current scanner technology requires an alignment process. The alignment must be checked periodically to ensure the target point on the bearing is maintained. The infrared camera will be insensitive to minor alignment variations and will not require this periodic maintenance.

Current systems require calibration of the sensor unit using a calibrated heat source. Railroads must perform this as part of regular maintenance. A missed alarm due to a sensor unit out of calibration would be an inexcusable situation. The infrared camera will be calibrated at manufacture and will not require regular calibration.

Current systems require a right hand and a left hand scanner. This increases the spare parts count. The infrared camera can be installed on either side.

HBD system need to be available around the clock, seven days a week. The use of standby power is difficult to implement because of the power required for the scanner heaters (both Harmon and Servo use scanner heaters). The infrared camera does not require high wattage scanner heaters, making a reasonable size standby power system possible.

Present system are EPROM based. Software upgrades or bug fixes require a field visit to every site (a nightmare). Using the APU-102 allows new code to be downloaded over a phone line.

Although the invention has been described in detail with reference to the presently preferred embodiment, those skilled in the art will appreciate that various modifications can be made without departing from the invention. Accordingly, the invention is defined only by the following claims.

We claim:

1. Apparatus for inspecting a wheel or bearing of a railroad car while the railroad car moves along a track, wherein the apparatus detects the presence of an abnormal temperature condition in the wheel or bearing, the apparatus comprising:

a first linear-array infrared detector located adjacent to a track on which the railroad car is moving, wherein the first infrared detector has an elongated, generally vertically oriented field of view, and wherein the first infrared detector is positioned such that its field of view is traversed by the wheel or bearing of the railroad car;

a first scan controller that repeatedly reads the first linear-array infrared detector to produce a succession of scan signals at a prescribed scanning rate, each scan signal representing the infrared energy emitted by any objects located in the first detector's field of view, such that while the wheel or bearing of the railroad car moves through the detector's field of view, the succession of scan signals represent the infrared energy emitted by a two-dimensional area of the wheel or bearing, wherein the scanning rate is regulated according to a velocity that the railroad car is traveling along the track; and a first processor that receives the successive scan signals from the first infrared detector and detects any abnormally high temperature condition in any wheel or bearing passing through the first infrared detector's field of view.

2. Apparatus as defined in claim 1, further comprising a second linear-array infrared detector located adjacent to said track, wherein the second infrared detector has an elongated, generally vertically oriented field of view, wherein said second infrared detector is positioned such that its field of view is traversed by a wheel or bearing of the railroad car, and wherein said first linear-array infrared detector and said second linear-array infrared detector are positioned adjacent opposite horizontal sides of said track.

3. Apparatus as defined in claim 2, further comprising:

a second scan controller that repeatedly reads the second infrared detector to produce a succession of scan signals, each scan signal representing the infrared energy emitted by any object located in the second detector's field of view, such that while the wheel or bearing of the railroad car mores through the second detector's field of view, the succession of scan signals represent the infrared energy emitted by a two-dimensional area of the wheel or bearing; and a second processor that receives the successive scan signals from the second infrared detector and detects any abnormally high temperature condition in any wheel or bearing passing through the second infrared detector's field of view.

4. Apparatus as defined in claim 1, wherein:

the railroad car includes a wheel associated with each of said bearings; and said first linear-array infrared detector is positioned to cover a field of view such that the temperature of said wheel or bearing can be sensed for wheels having different diameters.

5. Apparatus as defined in claim 1, wherein said field of view covers approximately seventy degrees.

6. Apparatus as defined in claim 1, wherein said first linear-array infrared detector comprises a thermo-electric microthermopile array.

7. Apparatus as defined in claim 1, further comprising a sealed vacuum package that houses said first linear-array infrared detector.

8. Apparatus as defined in claim 1, wherein said succession of scan signals taken by said first linear-array infrared detector at said prescribed scanning rate produces a two-dimensional image of said wheel or bearing, said image having a prescribed aspect ratio.

9. Apparatus as defined in claim 1, wherein said scanning rate is selected to scan locations on the wheel or bearing that are separated from the location of adjacent scans by a prescribed distance taken in a direction parallel to the track.

10. Apparatus for inspecting a wheel or bearing of a track-bound vehicles for abnormal temperature conditions, the apparatus comprising:

a first linear-array infrared detector containing a plurality of pixels, located adjacent to the track, wherein the pixels are vertically spaced along an array that is arranged generally perpendicularly to said track;

a first scan controller that repeatedly scans input values from a plurality of pixels in said first infrared detector at a prescribed scanning rate, to produce a first succession of scan signals, each scan signal indicating levels of infrared energy emitted by any objects located in a field of view of the first infrared detector, wherein the scanning rate is regulated according to a velocity that the vehicle is traveling along the track; and a first processor that receives the successive scan signals from the first infrared detector and correlates said scan signals with predetermined scan values relating to abnormally high bearing temperatures.

11. Apparatus as defined in claim 10, further comprising a second linear-array infrared detector containing a second plurality of pixels, located adjacent to the track, wherein the second plurality of pixels are vertically spaced along an array that is arranged generally perpendicularly to said track, and wherein said second infrared detector is positioned along an opposite horizontal side of said track from said first linear-array infrared detector.

12. Apparatus as defined in claim 11, further comprising:

a second scan controller that repeatedly scans input values from a plurality of pixels in said first infrared detector at a prescribed scanning rate, to produce a second succession of scan signals, each scan signal indicating levels of infrared energy emitted by any objects located in a field of view of the second infrared detector, wherein the scanning rate is regulated according to a velocity that the vehicle is traveling along the track; and a second processor that receives the successive scan signals from the second infrared detector and correlates said scan signals with predetermined scan values relating to abnormally high bearing temperatures.

13. Apparatus as defined in claim 10, wherein:

the vehicle train includes a wheel associated with each of said bearings; and said second linear-array infrared detector is positioned to cover a field of view in a manner that the temperature of the wheel or bearing can be sensed for wheels having different diameters.

14. Apparatus as defined in claim 10, wherein said field of view covers approximately seventy degrees.

15. Apparatus as defined in claim 10, wherein said first linear-array infrared detector further comprises a thermoelectric microthermopile array.

16. Apparatus as defined in claim 10, further comprising a sealed vacuum package that houses the first linear-array infrared detector.

17. Apparatus as defined in claim 10, wherein said first succession of scan signals define two-dimensional image of said wheel or bearing, said image having a prescribed aspect ratio.

18. Apparatus as defined in claim 10, wherein said scanning rate is selected to scan locations on the wheel or bearing that are separated from the location of adjacent scans by a prescribed distance taken in a direction parallel to the track.

19. A method for sensing the temperature of a wheel or bearing on vehicles traveling along a track, comprising:

positioning a linear-array infrared detector adjacent to said track;

scanning the output from said linear-array infrared detector at a prescribed scanning rate, wherein the scanning rate is regulated according to a velocity that said vehicle is traveling along the track; and comparing said output to predetermined thresholds indicating excessive heat produced by said wheel or bearing.

20. A method as defined in claim 19, wherein said predetermined thresholds vary based upon said positioning step.

21. A method as defined in claim 19, further comprising the step of providing an audible detect report if said output exceeds a predetermined threshold.

22. A method as defined in claim 19, wherein said scanning said wheel or bearing at said prescribed scanning rate produces a two-dimensional image of said wheel or bearing, said image having a prescribed aspect ratio.

23. A method as defined in claim 19, wherein the prescribed scanning rate is selected such that each scan is directed at scan locations on said wheel or bearing that are separated from the locations of adjacent scans by a prescribed distance taken in a direction parallel to the track.

24. Apparatus that is capable of inspecting a wheel or bearing of a vehicle traveling along a track for abnormal temperature conditions, comprising:

an infrared detector array located adjacent to a track on which the vehicle can move, and being positioned such that its field of view is traversed by said wheel or bearing traveling along the track;

a scan controller that controls scanning of the infrared detector array to produce a succession of scan signals taken at a prescribed scan rate, the succession of scan signals representing the infrared energy emitted by any two-dimensional area of said wheel or bearing positioned in said field of view, the scan rate being controlled according to a velocity that the vehicle is travelling to produce a two dimensional wheel or bearing image having a prescribed aspect ratio; and a processor that receives the successive scan signals and detects any abnormal temperature condition of said wheel or bearing passing through the infrared detector's field of view.

25. A method for scanning a prescribed two-dimensional area of a wheel or bearing of a vehicle traveling along a track for emitted infrared energy, the method comprising:

positioning an infrared detector array adjacent to the track such that the infrared detector array's field of view can be traversed by the wheel or bearing;

scanning the infrared detector array at a modifiable scan rate to produce a succession of scan signals that define a two-dimensional image, each scan signal representing the infrared energy contained in said field of view; and controlling the scan rate according to a velocity that the vehicle is traveling such that the two-dimensional image has a prescribed aspect ratio.

26. Apparatus that is capable of inspecting a wheel or bearing of a vehicle traveling along a track for abnormal temperature conditions, the apparatus comprising:

an infrared detector array located adjacent to the track and positioned such that its field of view is traversed by the wheel or bearing traveling along the track;

a scan controller that controls scanning of the infrared detector array at a controllable rate, said rate being selected according to a velocity that the vehicle is traveling to scan locations on said wheel or bearing that are separated from the locations of adjacent scans by a prescribed distance taken in a direction parallel to the track; and a processor that receives and processes the successive scan signals.

27. A method for scanning a prescribed two-dimensional area of a wheel or bearing of a vehicle traveling along a track for emitted infrared energy, the method comprising:

positioning an infrared detector array adjacent to the track such that the infrared detector array's field of view is traversed by the wheel or bearing traveling along the track;

repeatedly scanning the infrared detector array at a modifiable scan rate, to produce a succession of scan signals; and controlling the scan rate according to a velocity that the vehicle is traveling to scan a location on said wheel or bearing that is separated from the locations of adjacent scans by a prescribed distance taken in a direction along the track.

28. Apparatus that is capable of inspecting a wheel or bearing of a vehicle traveling along a track for abnormal temperature conditions, comprising:

an infrared detector array located adjacent to the track and positioned such that its field of view is traversed by the wheel or bearing traveling along the track;

a scan controller that controls scanning of the infrared detector array at an adjustable scan rate, the scan rate being regulated according to the velocity of the vehicle as it passes the infrared detector array; and a processor that receives the successive scan signals and detects any abnormal temperature condition of wheel or bearing passing through the infrared detector's field of view.

29. A method for scanning a prescribed two dimensional area of a wheel or bearing of a vehicle traveling along a track for emitted infrared energy, the method comprising:

positioning an infrared detector array adjacent to the track such that the infrared detector array's field of view is traversed by the wheel or bearing traveling along the track;

repeatedly scanning the infrared detector array at a modifiable scan rate, to produce a succession of scan signals; and controlling the scan rate according to a velocity that the vehicle is traveling along the track.

* * * * *